US006253454B1

(12) United States Patent
Gietzen

(10) Patent No.: US 6,253,454 B1
(45) Date of Patent: Jul. 3, 2001

(54) DRYWALL TOOL

(76) Inventor: Richard F. Gietzen, 7 Brandy Wine Ter., Rochester, NY (US) 14623

( * ) Notice: Subject to any disclaimer, the term of this patent is extended or adjusted under 35 U.S.C. 154(b) by 0 days.

(21) Appl. No.: 09/329,160

(22) Filed: Jun. 9, 1999

(51) Int. Cl.[7] ..... B26B 1/00

(52) U.S. Cl. ..... 30/136; 30/169; 30/339; 15/236.08; D32/49

(58) Field of Search ..... 30/136, 169, 286, 30/287, 292, 293, 294, 306, 314, 315, 317, 319, 329, 332, 337, 339; 15/236.01, 236.05, 236.06, 236.08; D32/46, 49

(56) References Cited

U.S. PATENT DOCUMENTS

| | | | | |
|---|---|---|---|---|
| D. 156,638 | | 3/1948 | Lifshutz et al. . | |
| D. 204,480 | | 4/1966 | Skarsten . | |
| D. 303,859 | | 10/1989 | Durgin . | |
| D. 307,206 | | 4/1990 | Boyd . | |
| D. 327,553 | | 6/1992 | Gringer . | |
| D. 344,617 | | 2/1994 | Farmer . | |
| D. 372,349 | | 7/1996 | Adair . | |
| D. 394,923 | | 6/1998 | Hellinger et al. . | |
| 758,071 | | 4/1904 | Hiles . | |
| 790,228 | | 5/1905 | Rohrer . | |
| 1,068,731 | | 7/1913 | Blum . | |
| 1,791,710 | | 2/1931 | Bullock . | |
| 2,287,231 | | 6/1942 | Cathcard et al. . | |
| 2,541,559 | * | 2/1951 | Ternullo | 30/136 |
| 2,634,498 | * | 4/1953 | Abrahamsen | 30/339 |
| 2,719,316 | | 10/1955 | Hauser . | |
| 3,275,187 | | 9/1966 | Lamoreaux . | |
| 4,449,299 | * | 5/1984 | Mulrooney | 30/169 |
| 4,546,513 | * | 10/1985 | Hammond | 30/169 |
| 4,813,458 | | 3/1989 | Jacobucci . | |
| 4,890,351 | * | 1/1990 | Wilson | 30/169 |
| 4,955,138 | * | 9/1990 | Henke et al. | 30/169 |
| 5,255,406 | | 10/1993 | Rood . | |

* cited by examiner

*Primary Examiner*—Hwei-Siu Payer
(74) *Attorney, Agent, or Firm*—Brian B. Shaw, Esq.; Stephen B. Salai, Esq.; Harter, Secrest & Emery LLP

(57) ABSTRACT

The tool of the present invention is designed to facilitate small repairs in walls. It is useable to repair dents, holes, and cracks in dry wall, plaster, stucco, or like materials. It is also useable to install drywall. The tool has a plurality of groove forming cutting edges which are used to cut into the damaged area or the non-beveled peripheries of newly installed panels to a predetermined depth. The grooves help loosen the material. A gouging blade of the tool is used to remove the weakened material and form a trough of a predetermined depth. Edges of the head of the tool project out on either side of the gouging blade to act as a depth control agent. The tool of the present invention is used in the method of the present invention in which a plurality of grooves are formed centered on a crack, criss cross grooves are also formed to further weaken the layer of the wall material, a trough is gouged out, netting is placed in the trough, and compound or plaster is spread into the trough. The method reduces problems with bulging of the repaired area.

40 Claims, 10 Drawing Sheets

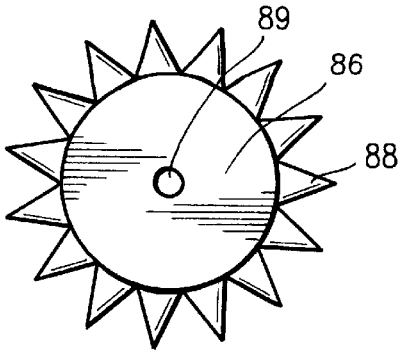
FIG. 10A
FIG. 10B
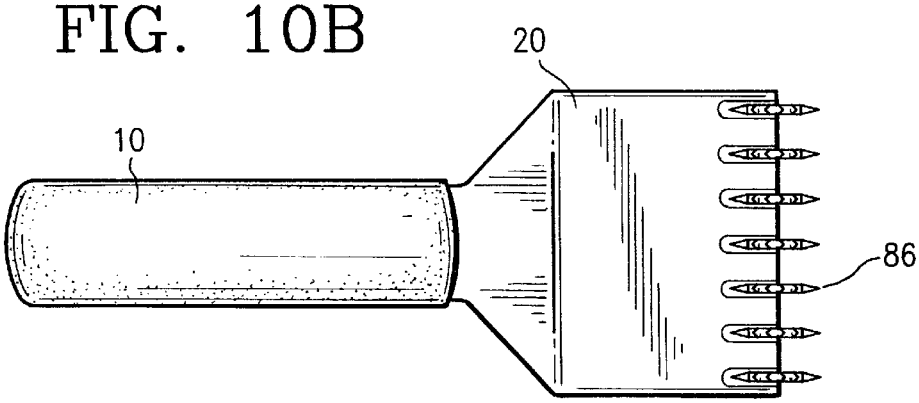
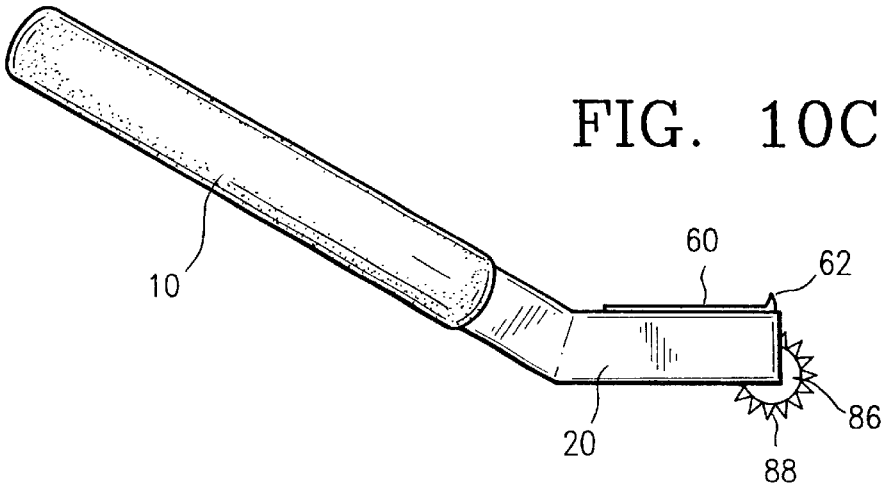
FIG. 10C

DRYWALL TOOL

FIELD OF THE INVENTION

The present invention relates to a tool used in patching damaged surfaces or removing a surface layer to a certain depth and method of repairing surface damage or installing wall panels employing this tool. This tool is especially designed to repair cracks, holes and breaks associated with damaged surfaces or install new dry wall surfaces.

BACKGROUND OF THE INVENTION

Walls are frequently damaged. It is common for buildings to settle over the course of time resulting in cracks. Old plaster may loosen and crack and start to fall off the wall or ceiling. Also, during even ordinary use, walls become damaged. Dents are formed by door knobs banged into walls, furniture which impacts walls, and children at play. In many cases, the damaged area can be repaired instead of replacing the wall.

For very small repairs, iron on patches have been used in which a polymer fabric is cut to size and ironed with a household iron set at medium heat. Compound is applied over the fabric and sanded when the compound has dried.

If the repair area is sizable, patching tape is used to help hold in the plaster. In repairing the damaged area, loose plaster or dry wall is removed, often with a screwdriver or putty knife. Slightly bending the corners of the screwdriver or knife against the wall cleans out a trough. Sandpapering may be done to provide a rough surface which adheres plaster well.

When a crack or damaged area is large, the wet plaster will not stick. The trough is fit with a mesh or perforated tape which is cut and placed into the trough. Plaster is laid over the mesh. Crisscross motions with a putty knife help to level off the plaster. Any excess plaster is squeezed out so there will not be a lump in the wall. If the patch shrinks too much as it dries, a second coat is applied. Very light sanding with 200+ to 400+ sandpaper or wiping with a dampened sponge the repaired area helps to blend in the repair with its surroundings. If the appearance of the repair is unsatisfactory, it may be brushed down with sandpaper until all edges are broken down.

The prior art repair techniques are deficient in that usually a bulge of plaster extends out from the site of the repair. Also, the prior art techniques require a large amount of scraping with a single blade. The prior art repair techniques do not remove a layer to a precise predetermined depth. When cracks are repaired by simply covering the cracks with dry wall compound, they have a tendency to reappear. Adding tape over the crack helps some, but doesn't eliminate the problem in that bulges will be visible.

Also, in putting up drywall, beveled edge panels are unavailable. It becomes necessary to join a non-beveled edge panel to another panel. Adding plaster to such a juncture results in bulging.

It would be useful to patch, join, repair and replace sections of a wall by a simple process in which the repair would blend imperceptibly with the undamaged remainder of the wall surface. A tool which would facilitate such a process would be welcome.

SUMMARY OF THE INVENTION

The present invention relates to a simple tool which permits removing a thin surface layer of plaster or dry wall to perform a patch.

The present invention relates to an apparatus for forming a trough in plaster, comprising a plurality of groove forming projections extending from a groove facet by a given distance, and within a fixed width, a scraper blade extending from the housing, the blade having a width less than the fixed width. The present invention also seeks to prevent from removing too deep a layer of wall material. The present invention also provides a mechanism for adjusting the scraper blade depth to project smaller distances.

The tool itself has a plurality of blades set into one face of the tool, and a scraper attached to the opposite face. The area of the dry wall surrounding the crack is scored with the blades. The tool is then reversed and the plaster material is removed with the scraper portion. The blades are held in place with a transverse screw that passes through holes in the blades, together with a plate that is clamped over the surface of the blades. Individual blades can be removed and replaced as necessary.

The present invention relates to a tool which forms grooves in a surface and also controls the depth to which a top layer is removed from the original surface.

The present invention relates to a tool which is easy to use and precise. It optionally has an adjustable depth gouging blade to vary the depth of the top layer of a surface to be repair.

The present invention relates to a method for repairing a surface in which generally parallel cuts are simultaneously made in the surface in one direction, other generally parallel cuts are made in a generally perpendicular direction, gouging to a predetermined depth is performed to remove a top layer to form a recessed area, an initial coating of plaster is placed within the recessed area, mesh or netting is then placed onto the initial coating of plaster in the recessed area and a final coating of plaster is spread over the mesh or netting so as to match the surrounding surface.

Although the present tool is especially meant to be used to repair or install dry wall, it also is able to repair plaster/lathe and stucco.

BRIEF DESCRIPTION OF THE DRAWINGS

FIG. 10A shows a pointed wheel in a sixth embodiment of the present invention.

FIG. 10B shows a bottom view of the sixth embodiment of the present invention.

FIG. 10C shows a side view of the sixth embodiment of the present invention.

DETAILED DESCRIPTION

Since World War II, dry wall (wallboard, gypsum board, Sheetrock) has been the material most commonly used for interior walls because it's quicker to install than plaster and is also easier for the average homeowner to repair. Nevertheless, plaster and stucco are also used to form interior walls. The present tool is designed to repair cracks and other minor damaged areas on a wall as well as in construction of new walls.

The surface layer removing tool of the present invention is used to first weaken a surface layer of a certain depth and then to scrape out the weakened area to a controlled depth. The present tool has a side dedicated to weakening an area and another side for removing the weakened area.

Figure 1:
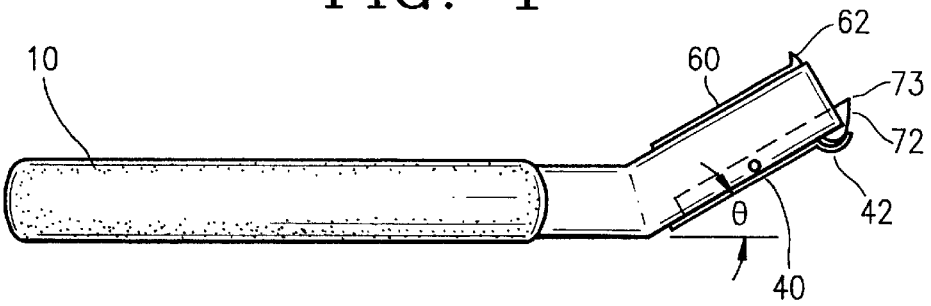
FIG. 1 shows a side view of a first embodiment of the dry wall tool.

FIG. 1 shows a side view of a first embodiment of the present invention. A handle 10 forms the major part of the length of the tool 5. The head 20 carries the groove forming projections 72 and the scraping or gouging blade 62. The handle 10 is integral with or firmly attached to the head 20. The handle 10 and head 20 may be formed of molded plastic, aluminum, wood, or other rigid material which holds up well to those mechanical forces encountered in penetrating a wall, forming grooves, and scraping into the wall material. In the preferred embodiment, the head 20 is a generally rectangular solid which has a flattish appearance. In the preferred embodiment, the handle 10 has a thickness similar to the thickness of the head 20 and a width which makes the handle 10 comfortable to hold for a typical person. In FIG. 1, the gouging blade plate 60 forms one piece with the gouging blade 62. The groove forming edge guard 42 prevents damage to a point 73 of the groove forming projection 72. The face 75 of the tool is the primary limiter of the penetration depth. The edge guard 42 ensures the security and safety of the blades and prevents injury to the user. It generally is useful to limit the depth that is cut into a wall to form a trough of a particular desired depth. The term "wall" is a generic term meant to encompass ceilings and other surfaces. Retention plate 40 and edge guard 42 form a single piece.

The handle 10 is contoured to comfortably be held by a hand. The handle 10 is tapered toward the end where it is attached to the head 20 so as to prevent the handle from slipping out of the user's grip. The major plane of extension of the head 20 forms an angle with the longitudinal axis of the handle 10. The angle is preferably non-zero to allow the user to have more control and apply force better to form grooves into a surface; especially, when the user is in a standing position. It has been found that the maximum benefit for a user occurs when the head 20 is set at an angle $\theta$ from 20 to 50 degrees from the handle 10; a 30° setting is more preferred. An earlier experimental version of the tool 5 which had an angle $\theta$ of less than 20° between the longitudinal axis of the handle and the major planar extension of the head was only somewhat satisfactory.

The head 20 of the tool 5 is a generally flat body. It is generally tapered at the side 28 connected to the handle 10 so as to match the width of the handle 10 at the point of attachment. The head may have holes 32 for passing through a bolt, nail, screw, rivet, or other attaching means. The surface 75 of the head 20 distal to the handle 10 is the preferred surface from which to project the groove forming edges 72. The groove forming projection surface 75 is oriented approximately perpendicular to the longitudinal axis of the handle 10, thus presenting a greater exposure of a cutting edge of the groove forming projections.

Figure 2:
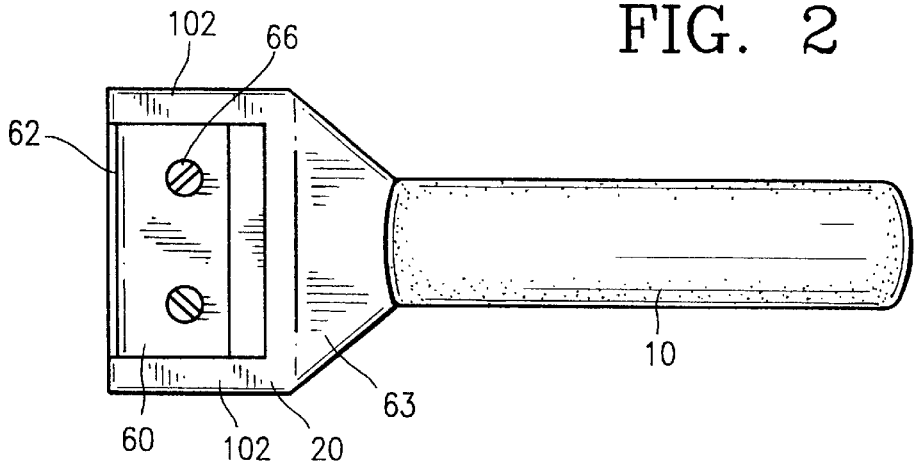
FIG. 2 shows a top view of the first embodiment of the present invention.

FIG. 2 shows the top side of the tool 5. A gouging blade 62 is formed on one end of the gouging plate 60. Affixing means, such as screws 66, are used to secure the gouging plate to the head 20. As needed, the gouging plate 60 may be removed so as to sharpen or replace the gouging blade 62.

The gouging plate 60 is disposed on the surface opposite to the retention plate 40. The form of the gouging plate 60 is similar in form to the retention plate 40. Two holes are similarly made approximately midway along the length of the gouging plate 60 so as to pass a screw 66 or bolt to retain the plate to the head 20. The edge of the plate which is along the surface 75 from which the groove forming projections 72 project out is bent so as to present a blade 62 which is generally coplanar with the surface from which the groove forming projections 72 project. The gouging edge 62 is ground or otherwise processed so as to present a reasonably shape edge that readily breaks through dry wall and wall paper. The gouging blade 62 projects up from the supporting surface 63 of head 20 in a generally perpendicular manner. The head 20 defines a stopping flange 102 relative to the gouging plate 60 and blade 62 as seen in FIG. 2.

Figure 3:
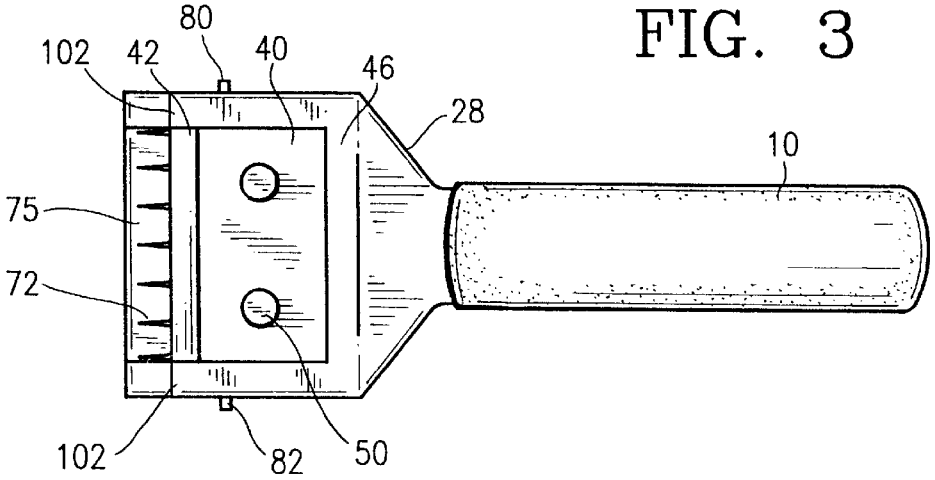
FIG. 3 shows a bottom view of the first embodiment of the present invention.

FIG. 3 shows a bottom view of the tool 5 in which a retention plate 40 has an edge guard 42 attached to the bottom surface 46 by bolts, rivets or screws 50. In order to facilitate replacement of the groove forming edges 72, it is preferable that the retention plate 40 be easily removable. Bolt 80 and screw 82 means are used to keep the bodies of the groove forming edges 72 securely within the head 20. Other means, such as a bolt and nut or rivets, may be used. For permanent bonding, a high strength adhesive may alternatively be used.

The tool of the present invention has a plurality of groove forming edges 72. The groove forming edges may be spikes, blades, or pointed wheels. Their purpose is to break through a surface layer to a depth in a fairly precise manner so as to limit any damage to essentially little more than the size of the individual groove forming edge. The head 20 and retention plate 40 in conjunction with the groove forming edges 72 define the stopping flange 102.

Figure 4:
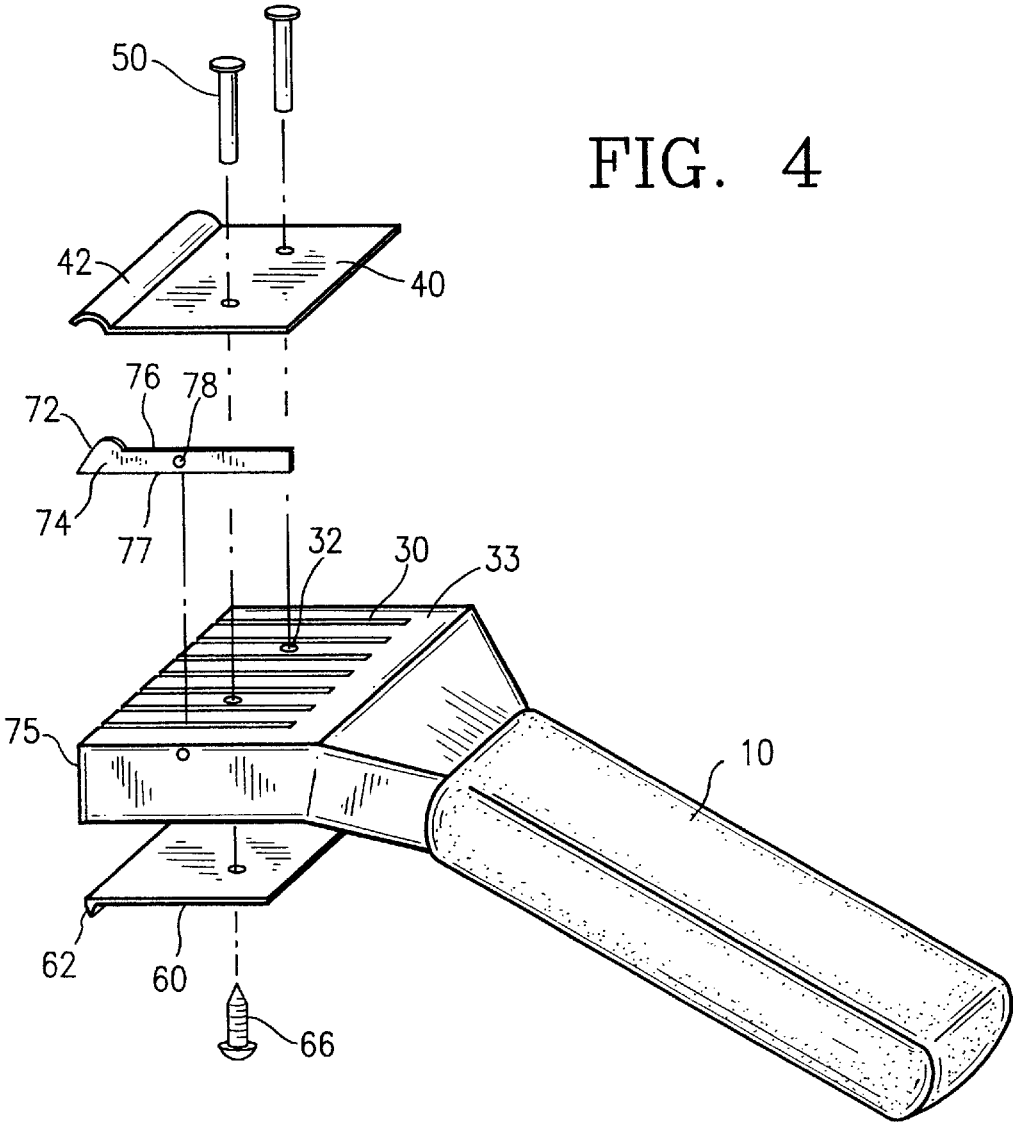
FIG. 4 shows an exploded view of the components of the first embodiment of the invention.

In an exploded view of the first embodiment, as shown in FIG. 4, slots 30 are formed in parallel on a surface 33 generally perpendicular to the surface 75 from which the groove forming edges project. The slots 30 may be molded or machined. Exacto® knives were ground down part way along their lengths. The side which merges with the arc of the curved cutting edge is ground out to a certain depth along its length. A grinder or cutting saw may be used to remove a certain depth along the entire length of the major edge until the cutting edge. This removal facilitates entry of the blade but also permits the cutting blade to be set at an appropriate angle for penetrating and cutting into a surface. Holes 78 were drilled into the knives 74 at the same corresponding location for all knives. The holes 78 allow passage of a screw or bolt so as to prevent the blades from slipping out of the head. Instead of holes, notches may be formed. The knives 74 were inserted into corresponding individual slots so the sides 77 opposite to the ground out sides 76 were inserted first. The knives 74 preferably are further sharpened before insertion.

After all the knives have been inserted, a retention plate 40 is placed over the slots 30 with knives inserted. The retention plate 40 is fixedly attached to the surface having the slots. A preferred way to fixedly attach the retention plate is through a bolt 50. Rivets and screws are other preferred securing means. In a specific implementation, the retention plate 40 is 2.5 inches wide and 1.5625 inches long. The end of the retention plate 40 which contacts the cutting edges is curved such that, in cross section, lengthwise, it appears almost as a semicircle 42. The retention plate 40 used was approximately 3/32 inches thick. Different plate thicknesses may be used. It may be made of metal or any other sufficiently strong material. Holes are made into the plate so as to attach it to the body of the head 20. The curved semicircle acts to prevent breakage of the cutting edges. It also helps to prevent accidental marking of the wall in the process of aligning the dry wall tool with the area to be repair. Additionally, it serves to provide depth control in the cutting. The bulge 42 serves to help control the depth to which the groove forming edges 72. The bulge functions as an edge guard 42. Alternatively, the head may be a molded piece of metal or plastic in which the mold is formed so as to include slots for retaining blades which have groove forming edges.

In a specific implementation of the first embodiment shown in FIGS. 1–4, the dry wall tool is a single unit which has one surface to indent 2½" of the dry wall area, ⅛ inch deep, a handle 1" thick, 1¼" wide at its widest to 1" at its narrowest where it meets the tapered end of the head, and 7" long. This surface 75 incorporates seven blades 72, such as shown in FIGS. 3 and 4, which are aligned and spaced in approximately 0.4 inch increments across the 2½ inch surface of the tool. The blades 72 from this surface 75 indent the dry wall surface and forms grooves. The dry wall tool 5 has a second surface 63 incorporating a scraping or gouging blade which will clear and level the 2½ inch indented area at a ⅛ inch or other preferred depth. This second surface 63 of the tool 5 adjoins the surface 75 from which the 7 blades project. After the dry wall surface has been indented, the gouging blade 62 of the second surface of the tool can be used to remove the dents and create a 2½ inch width, ⅛ inch depth groove to allow for the dry wall joint tape, self-adhesive net tape, and plaster coating to be sanded and finished at the same surface level of the surrounding wall. In this specific implementation, the total length of the tool was 9¾", the blades penetrated the head 20 to a maximum depth of 5/16", the head measures, along the longitudinal axis of the handle, and 2¼" at its bottom and 2¾" at its top.

Figure 5:
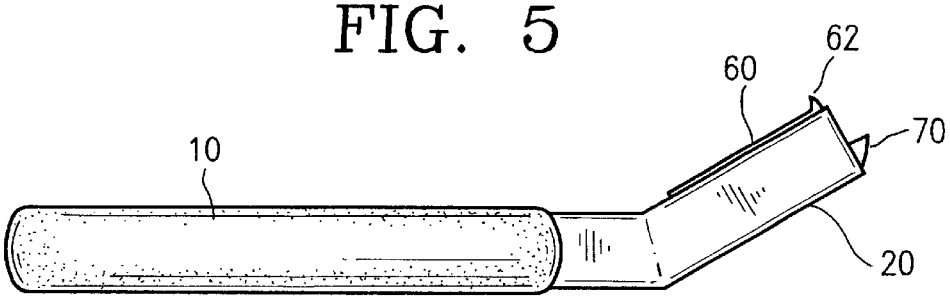
FIG. 5 shows a side view of a second embodiment of the present invention.

FIG. 5 shows a second embodiment in which the groove forming edges 72 are not secured by a retention plate with the head 20. The groove forming projections may be formed with the head as one solid piece such as a solid piece of metal. Other groove forming edges are readily contemplated, including spikes. It is important that the groove forming edge be able to penetrate through a surface to a depth similar to that penetrated by the gouging blade. The gouging blade 62 in the second embodiment is shown as part of plate 60.

Figure 6:
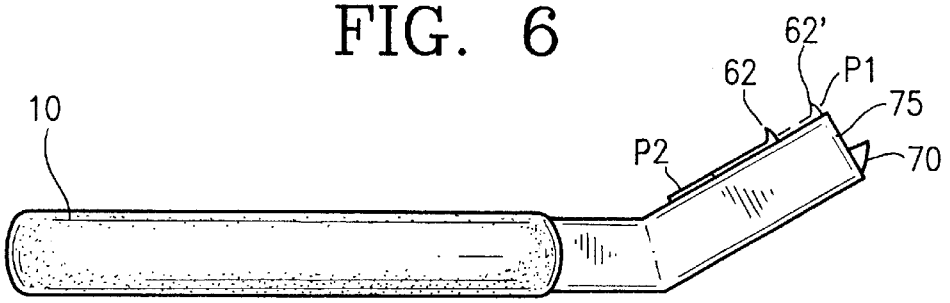
FIG. 6 shows a side view of a third embodiment of the present invention.

FIG. 6 illustrates a third embodiment in which the gouging blade 62 is adjustable by a sliding adjustment of the gouging plate 60. P1 shows the initial position of the gouging blade 62'. P2 shows the position of gouging blade 62 after the adjustment is made. A slot may be provided within the head 20 so as to provide a retentive housing for an adjustable gouging blade.

Figure 6A:
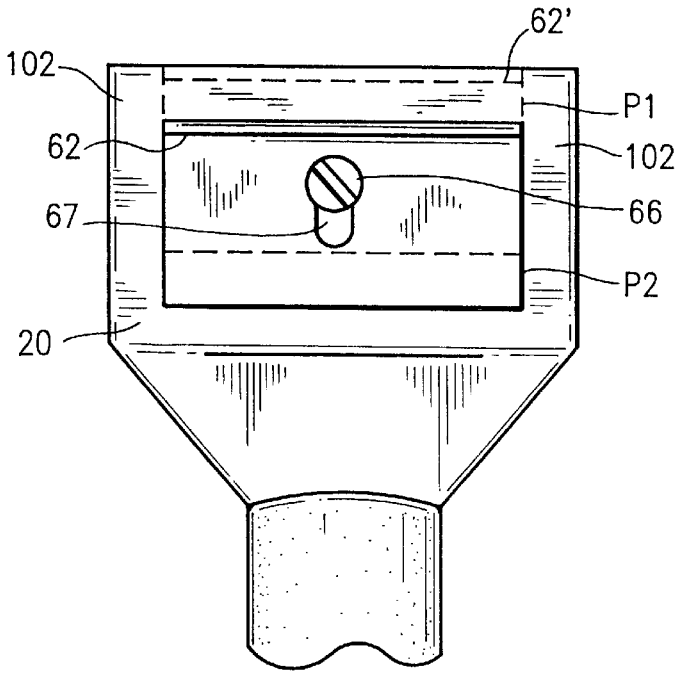
FIG. 6A shows a top view of the tool in the third embodiment having an adjustable gouging plate.

FIG. 6A illustrates the positions of the gouging blade and gouging plate in a top view of the third embodiment. A slot 67 permits the gouging blade 62 to travel from its original position 62'. This may be achieved by loosening the retaining means 66, such as a screw, and sliding the plate 60 into its new position. The adjustment mechanism may be designed to allow only two stable positions, such as for selecting gouging depths of ⅛ inch or 1/16 inch.

Figure 7:
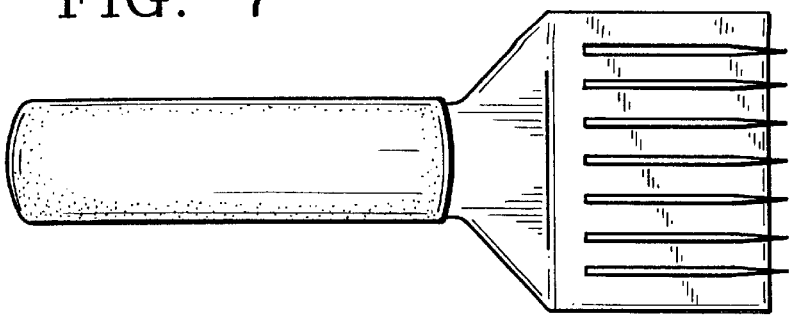
FIG. 7 shows a fourth embodiment in which groove forming blades are inserted into one facet of the head of the dry wall tool.
Figure 8:
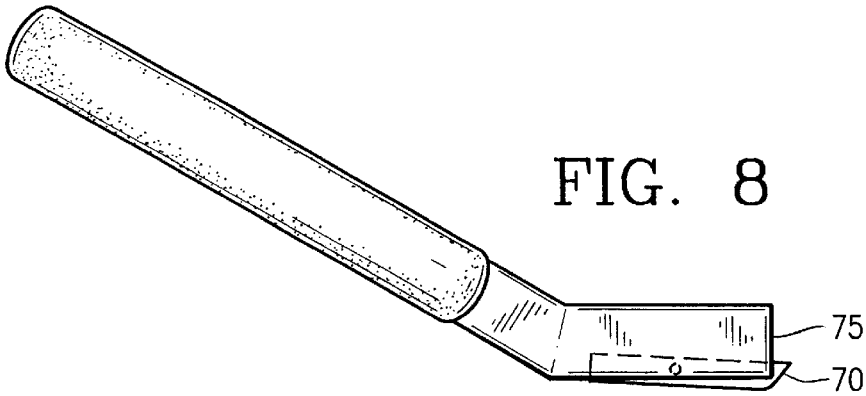
FIG. 8 shows a side view of the fourth embodiment.

FIGS. 7 and 8 show bottom and side views of a fourth embodiment in which the blades 70 are mounted without a retention plate or gouging blade.

Figure 9:
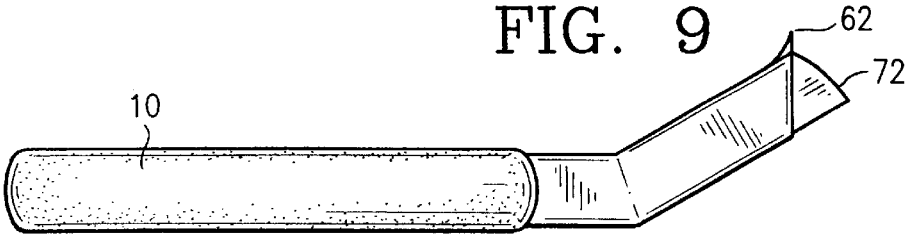
FIG. 9 shows a side view of a fifth embodiment of the present invention.
Figure 10:
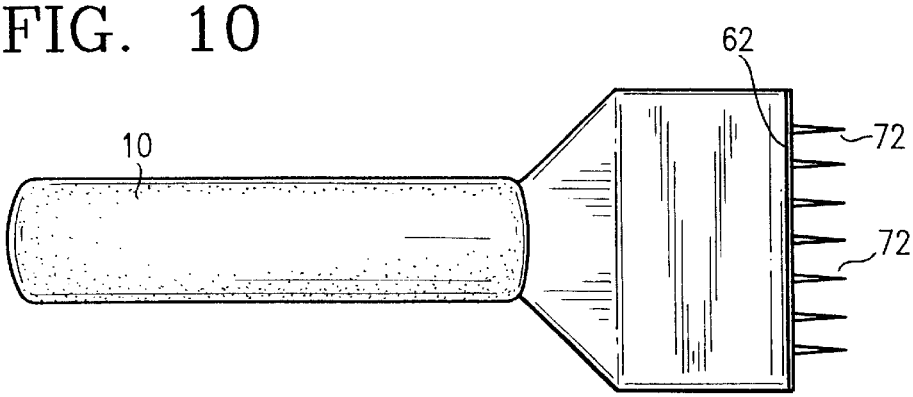
FIG. 10 shows a gouging blade view of the fifth embodiment of the present invention.
Figure 11:
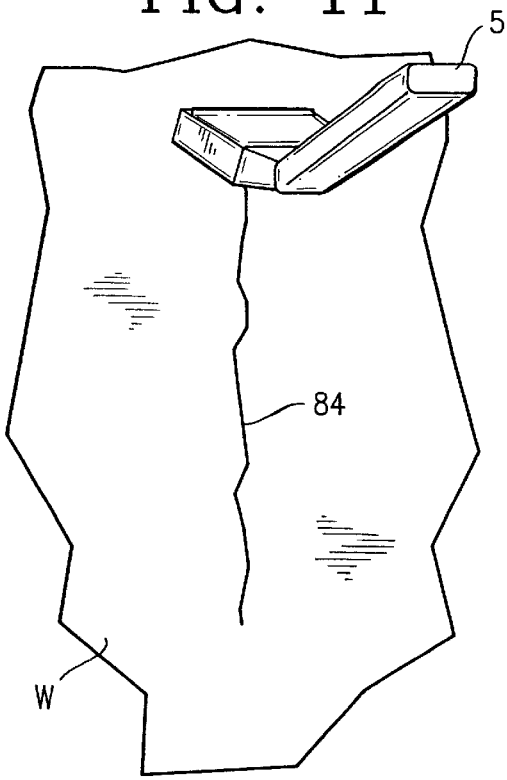
FIG. 11 shows the tool of the present invention being placed at the start of a crack in the wall to illustrate a method of the present invention.

FIGS. 9 and 10 show side and top views of a fifth embodiment in which the groove forming projections 62 and the gouging blade are formed as one integral piece with the head 20 and handle 10 of the tool 5.

FIGS. 10A, 10B, and 10C illustrate a sixth embodiment of the present invention. FIG. 10A shows a pointed toothed wheel 86 which rotates about an axle (i.e., a bolt) through aperture 89. Cutting teeth 88 are distributed over the circumference of the wheel 86. FIG. 10B shows a bottom view of the tool of the sixth embodiment. FIG. 10C shows a side view of the sixth embodiment having a gouging blade 62 and wheel 86 with cutting teeth 88.

FIGS. 3, 6A, 7, 10 and 10B each distinctly show the groove forming projections 72 disposed along a first facet width to define a groove forming width, the groove forming width being less than the first facet width of the head 20. The axle is supported in an aperture through head 20.

FIGS. 11–17 illustrate the steps of the method of the present invention as seen by someone practicing the method. In these Figures, a cracked wall is to be repaired.

Figure 12:
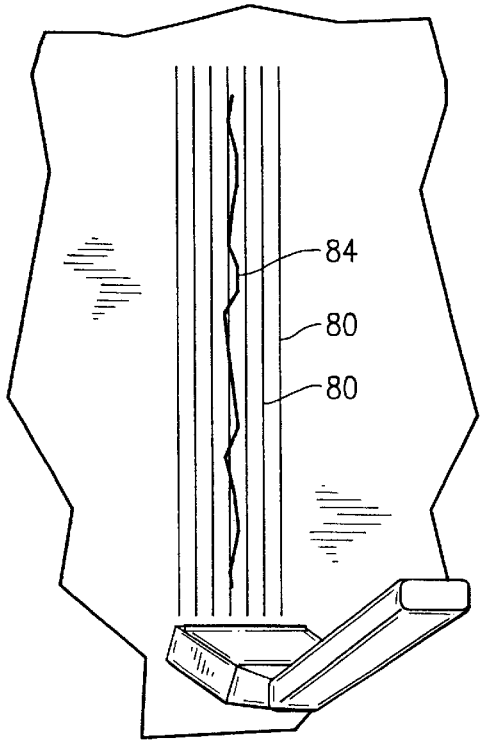
FIG. 12 shows the formation of parallel grooves centered on the crack in the method of the present invention.

In operation, the user holds the tool 5 with both hands applying force to the gouging plate side of the handle 10. The center groove forming projection 72 is aligned at one end of a crack 84. The user pushes the tool 5 toward the wall and with an up and down or back and forth motion, as needed, penetrates the wall surface. Once the wall is penetrated to the depth permitted by the setting of the tool, the user guides the tool so as to form grooves to the depth set, keeping the center groove forming section more or less within the crack, hole, or area to be repaired. The groove forming continues until the other end of the crack, hole, or area to be repaired has been passed through by the groove forming edges, as shown in FIG. 12.

Figure 13:
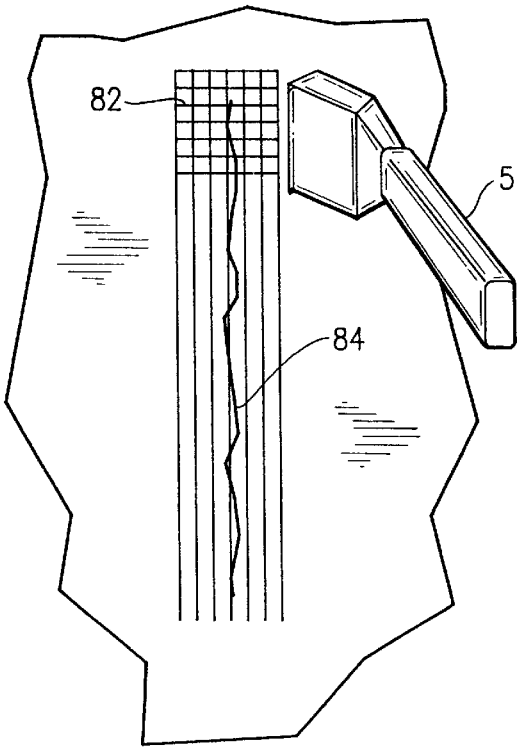
FIG. 13 shows the first criss cross motion across the first set of grooves in the method of the present invention.
Figure 14:
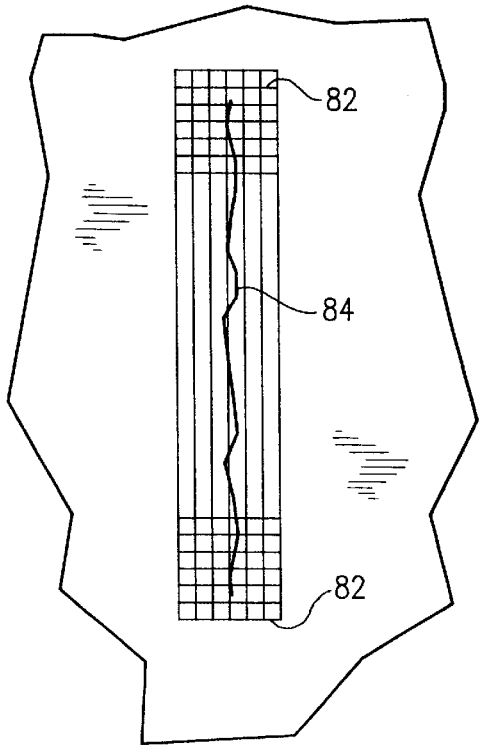
FIG. 14 shows a second criss cross motion across the first set of grooves in the method of the present invention.

Thereafter, the user may make a criss cross pattern 82 at least at each end of the grooves, as shown in FIGS. 13 and 14. At one side of the grooves at the end of the grooves, the user again uses both hands to push the tool to the wall and penetrating it to the permitted depth as set. The user may continue forming grooves across the first set of grooves until reaching the other side. The user then makes as similar criss cross pattern at the other end of the grooves. The user may form additional grooves in a criss cross pattern between the two ends of the first set of grooves to further weaken the surface layer of the wall for easier removal.

Figure 15:
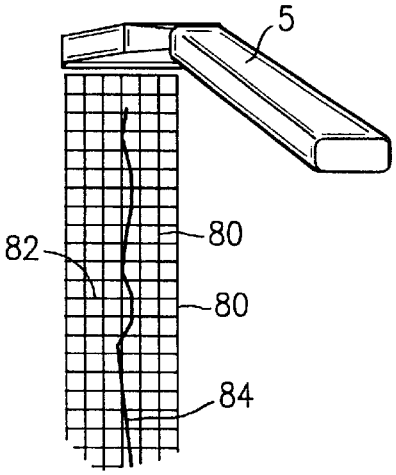
FIG. 15 shows the gouging blade starting at one end of the first set of grooves in the method of the invention.
Figure 16:
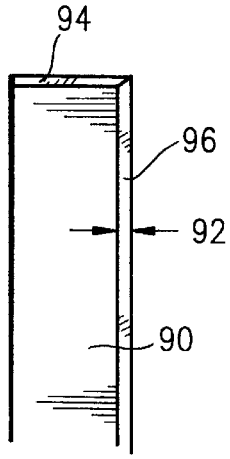
FIG. 16 shows the end of a trough formed by the gouging blade in the method of the present invention.

Next, as shown in FIG. 15, the user penetrates the wall with the gouging blade 62. The user starts to gouging at either end of the first set of grooves 80. The user, once started, makes back and forth motions, as needed, with the gouging blade so as to form a trough of a more or less constant depth, as shown in FIG. 16. The user scrapes with the gouging blade to smoothen out the trough 90. Walls 94 and 96 of the resulting trough 90 are formed to a predetermined depth 92 of the blade.

Figure 17:
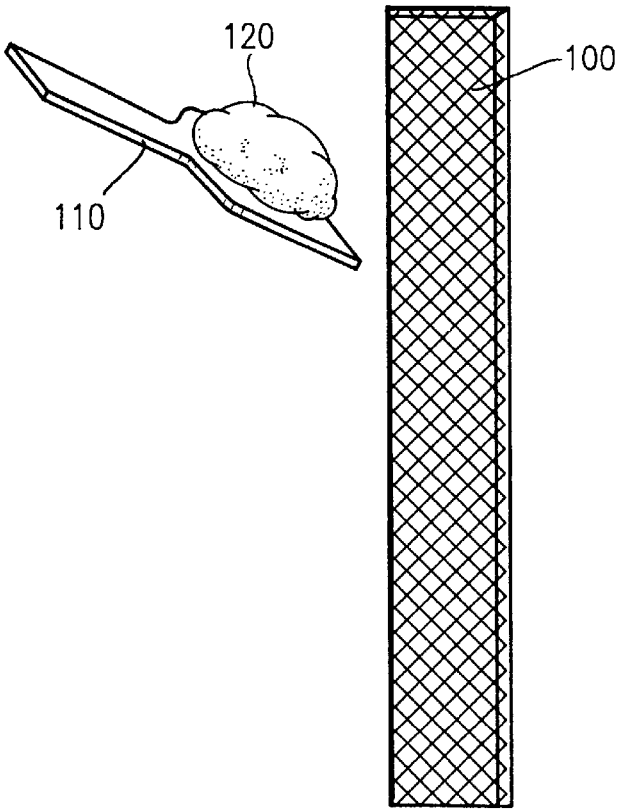
FIG. 17 shows mesh placed in a trough formed in the method of the present invention.
Figure 18:
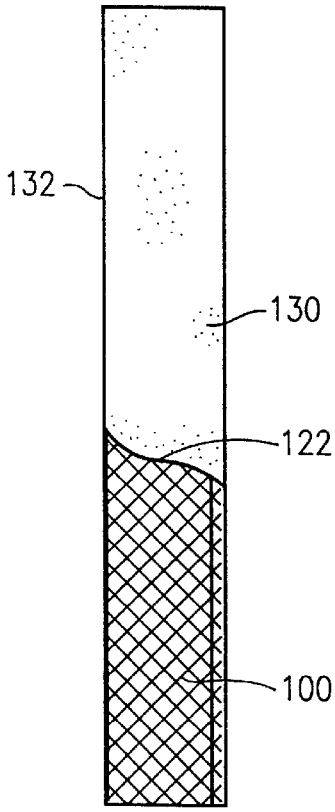
FIG. 18 shows a partially repair area of the wall in the method of the present invention.

Thereafter, the user deposits an initial coating of plaster followed by insertion of a mesh or netting 100, as shown in FIG. 17. Finally, the user puts in a second coating of plaster 120 and uses a trowel 110 to form a smooth surface 130 which matches the surrounding surface of the wall, as shown in FIG. 18. In FIG. 18, plaster or compound 122 is laid onto the mesh inside the trough. For illustration only, the patched area is marked 132 but would ideally not be visible.

Figure 19:
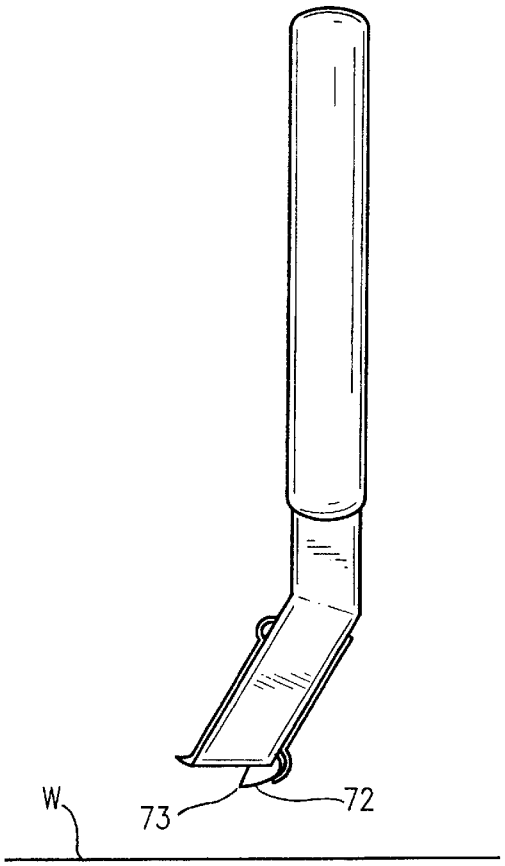
FIG. 19 shows the tools about to penetrate the wall to be repaired in the method of the present invention.
Figure 20:
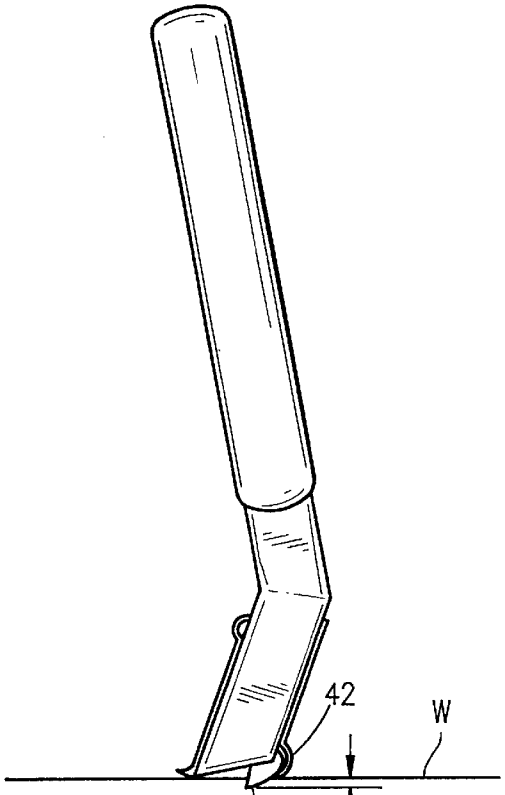
FIG. 20 shows the tool which has penetrated the wall to the maximum depth for forming grooves in the method of the present invention.
Figure 21:
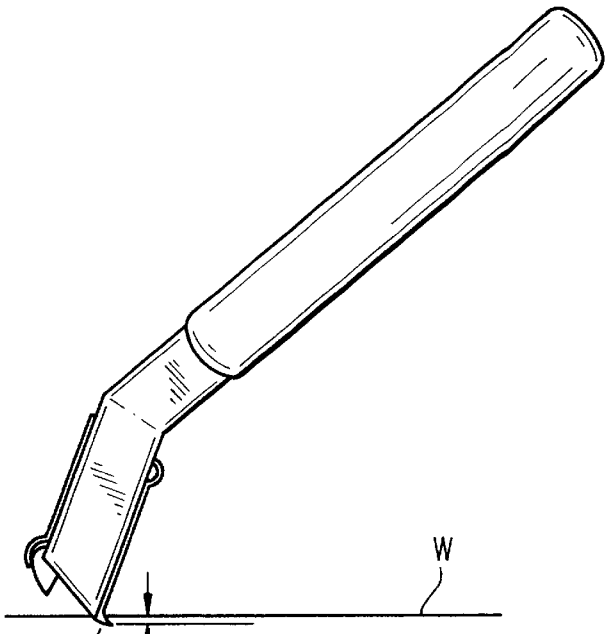
FIG. 21 shows the tool penetrating the wall with the gouging blade to form a trough in the method of the present invention.

FIGS. 19–21 show cross sectional views of the tool in use on a wall in the method of the present invention.

In FIG. 19, the groove forming edge 72 is shown about to penetrate the wall W with point 73 of the groove forming edge serving to initially pierce the outer surface of the wall.

FIG. 20 shows the groove forming edge 72 penetrating the wall W to its maximum depth D1 as determined by edge guard 42.

FIG. 21 shows the gouging blade 62 penetrating wall W to its maximum depth D2. Generally, the maximum groove depth D1 is equal to the maximum gouging depth D2.

Figure 22:
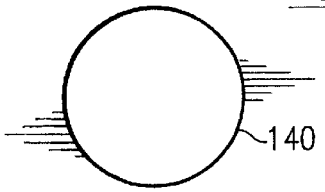
FIG. 22 shows a damaged area which is circular in which the method of the present invention is used.

In FIG. 22, a major area of damage such as a hole knocked into a wall is shown.

Figure 23:
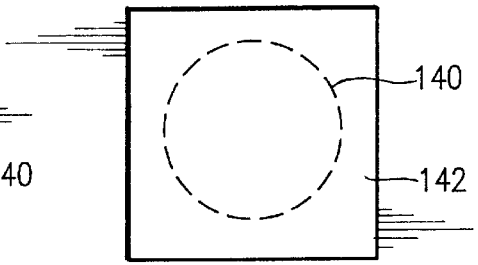
FIG. 23 shows the method of the present invention in which the damaged area is cut out.

In FIG. 23, a squarish or rectangular area 142 is cut out to remove the damaged area 140.

Figure 24:
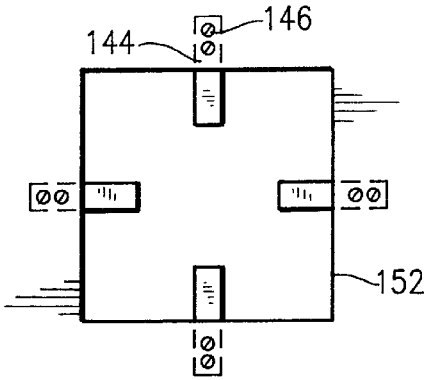
FIG. 24 shows the placement of support strips in the method of the present invention.

In FIG. 24, small rectangular pieces of support board 144 are screwed into the drywall by means of screws 146. The supporting boards 144 are affixed to the inside of the wall. Screws 146 are screwed into the board through the outside of the wall through the drywall. The screws are countersunk. A squarish aperture 152 permits a corresponding squarish piece of repair drywall to be inserted.

Figure 25:
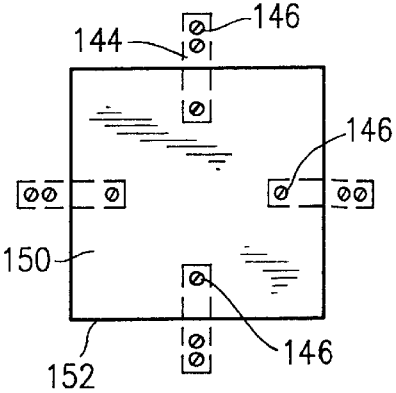
FIG. 25 shows the placement of a patched area of solid material in the method of the present invention.

In FIG. 25, a squarish piece of drywall or other patch material is placed within aperture defined by line 152. Screws attach the repair patch to the support board 144.

Figure 26:
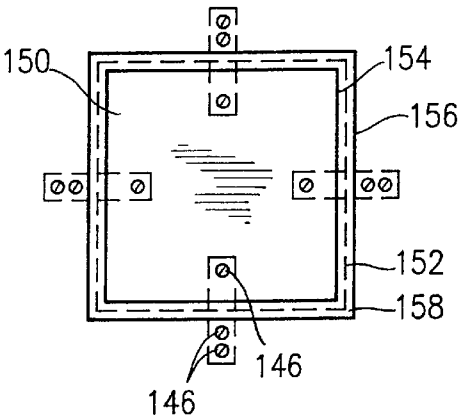
FIG. 26 shows the trough formed by the tool in making the patched area seamless in the method of the present invention.

In FIG. 26, the tool is used to form a trough 158 in the wall and patch area 150. The trough is defined by an inner perimeter 154 and an outer perimeter 156. The width of the trough is such that it does not interfere with the screw holding the repair patch 150 or the screws which support the support board to the wall. The aperture 152 falls midway between inner perimeter 154 and outer perimeter 156.

Figure 27:
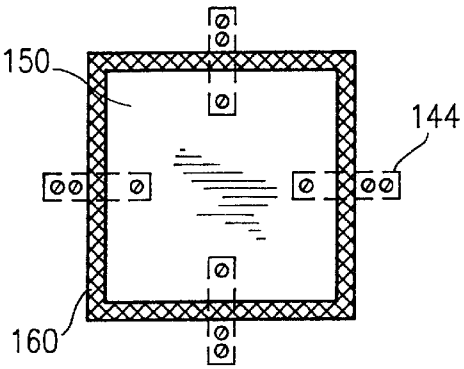
FIG. 27 shows the placement of netting or mesh in the method of the present invention.

In FIG. 27, mesh or netting 160 is cut and placed within the trough 158.

Figure 28:
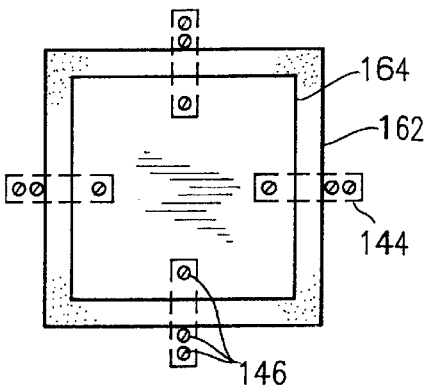
FIG. 28 represents the area in which the dashed lines and faint lines would not be visible in the wall as a result of the method of the present invention.

FIG. 28 shows the outline of the area which has been patched as well as the supporting board and screws. This figure only illustrates where the repair was done. Ideally, when the repair is made, there should be no visible trace of the repair work. Thus, lines 162 and 164 would be virtually invisible to a person on close inspection. Of course, support boards 144 are hidden on the inside of the wall. Screws 146 are plastered over so as to be undetectable.

Figure 29:
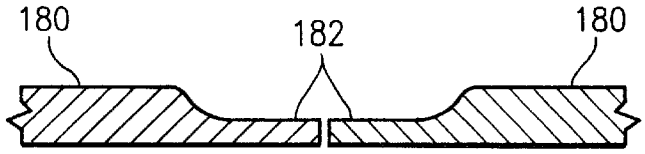
FIG. 29 shows two beveled edge panels placed side by side.

FIG. 29 shows, in a normal construction mode, where two beveled edges of adjoining drywall panel 180 are attached. The beveled edges 182 permit mesh and plaster to be placed in and smoothed out.

Figure 30:
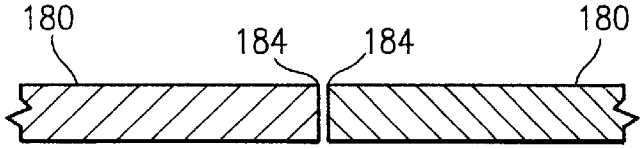
FIG. 30 shows two non-beveled edge panels placed side by side.

FIG. 30 shows non-beveled edged drywall panel put side by side. In this case, the adjoining edges 184 of the drywall panel 180 could be grooved out to form a trough as one would do in repairing a crack in the drywall.

Figure 31:
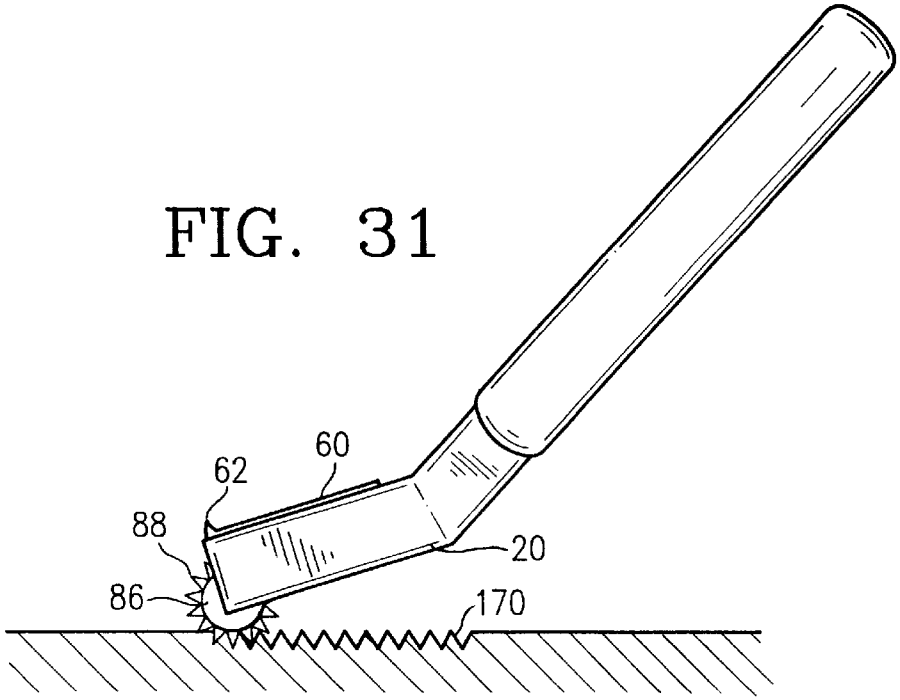
FIG. 31 shows the method of the present invention employing parallel rotating pointed toothed wheels.

FIG. 31 shows the notches 170 formed by the pointed toothed wheel 86 in the method of the present invention. Parallel wheels 86 help weaken the wall. Thereafter, gouging blade 62 removes the weakened surface layer.

In the preferred embodiment, seven groove forming edges have been used. It is contemplated that a greater of lesser number may be used. Somewhat successful results have been accomplished, for instance, with a tool having only three groove forming edges. The seven groove forming edges tool, as described herein, works markedly better than the three groove forming edges tool.

The present invention has been described only in terms of preferred embodiments. It is readily acknowledged that one of ordinary skill could through routine variation arrive at other changes within are within the scope and spirit of the present invention.

What is claimed:

1. A tool for repairing a wall, comprising:

a rigid handle having a length and a longitudinal axis which extends along the length;

a head fixedly connected to the handle and having a major planar extension, a width, and a first facet having a first facet width, the head comprising a plurality of groove forming projections which project from the first facet of the head, the groove forming projections disposed along the first facet width to define a groove forming width, the groove forming width being less than the first facet width;

wherein the angle formed between the longitudinal axis of the handle and the major planar extension of the head exceeds 20° but is less than 50°.

2. The tool of claim 1, wherein the groove forming projections are integral with the head.

3. The tool of claim 1, wherein the groove forming projections are removable.

4. The tool of claim 3, wherein the head includes a plurality of slots or apertures and each groove forming projection includes a body sized to be supported in the slots or the apertures in the head.

5. The tool of claim 4, further comprising a retention plate connected to the head to retain the groove forming projections relative to corresponding slots or aperture.

6. The tool of claim 4, wherein the body of each groove forming projection includes an aperture.

7. The tool of claim 3, further comprising a gouging blade for removing the area marked by the groove forming projections.

8. The tool of claim 7, wherein the gouging blade is removable from the head.

9. The tool of claim 7, wherein the gouging blade is adjustable to set the depth of penetration of the gouging blade.

10. The tool of claim 7, wherein the tool is structured to limit the penetration depth of the gouging blade.

11. The tool of claim 1, wherein the groove forming projections are located to form parallel grooves.

12. The tool of claim 11, wherein the tool is structured to limit the penetration depth of the groove forming projections to a predetermined depth.

13. The tool of claim 12, further comprising a gouging blade for removing an area marked by the groove forming projections, the gouging blade having a width, the gouging blade being supported by the head.

14. The tool of claim 13, wherein the gouging blade is removable from the head.

15. The tool of claim 13, wherein the gouging blade is adjustable to set the depth of penetration of the gouging blade.

16. The tool of claim 13, wherein the tool is structured so as to limit a penetration depth of the gouging blade.

17. The tool of claim 16, wherein the structure which limits the penetration depth of the gouging blade is the head.

18. The tool of claim 13, wherein the width of the gouging blade is less than the width of the head.

19. The tool of claim 1, further comprising a gouging blade for removing the area marked by the groove forming projections.

20. The tool of claim 1, wherein the handle is removable from the head.

21. The tool of claim 1, wherein the handle and the head are integral.

22. The tool of claim 1, wherein the groove forming projections are pointed toothed wheels.

23. The tool of claim 22, wherein the wheels rotate relative to the head.

24. An apparatus for removing portions of a wall, comprising:

a handle having a head, the head having a contact face and a stopping flange;

a plurality of spaced apart groove forming projections extending from the contact face to a height, the groove forming projections having a maximum spacing between a first groove forming projection and a last groove forming projection; and a gouging blade connected to the head and spaced from the groove forming projections, the gouging blade having a width substantially equal to the maximum spacing and a maximum distance from the head which is substantially equal to the height of the groove forming projections.

25. The apparatus of claim 24, wherein the groove forming projections are integral with the head.

26. The apparatus of claim 24, wherein the groove forming projections are removable.

27. The apparatus of claim 26, wherein the head includes a plurality of slots or apertures and each groove forming projection includes a body sized to cooperatively align with a corresponding slot or aperture in the head.

28. The apparatus of claim 27, further comprising a retention plate sized to retain the body of the groove forming projection relative to a corresponding aperture or slot.

29. The apparatus of claim 27, wherein the body of each groove forming projection includes an aperture.

30. The apparatus of claim 24, wherein the groove forming projections are selected to form parallel grooves.

31. The apparatus of claim 30, wherein the apparatus is structured to limit the penetration depth of the groove forming projections to a predetermined depth.

32. The apparatus of claim 24, wherein the gouging blade is removable from the head.

33. The apparatus of claim 24, wherein the gouging blade is adjustable to set a depth of penetration of the gouging blade.

34. The apparatus of claim 24, wherein the apparatus is structured so as to limit the penetration depth of the gouging blade.

35. The apparatus of claim 34, wherein the structure which limits the penetration depth of the gouging blade is a portion of the head.

36. The apparatus of claim 24, wherein the handle is removable from the head.

37. The apparatus of claim 24, wherein the handle and the head are integral.

38. The apparatus of claim 24, wherein the width of the gouging blade is less than a width of the head.

39. The apparatus of claim 26, wherein the groove forming projections are pointed toothed wheels.

40. The apparatus of claim 39, wherein the wheels rotate relative to the head.

* * * * *